US005238047A

United States Patent [19]

Sakata

[11] Patent Number: 5,238,047

[45] Date of Patent: Aug. 24, 1993

[54] ROLLER APRON FOR BEAM BLANK AND RECTANGULAR STRAND IN CONTINUOUS CASTING FACILITIES

[75] Inventor: Yutaka Sakata, Niihama, Japan

[73] Assignee: Sumitomo Heavy Industries, Ltd., Tokyo, Japan

[21] Appl. No.: 922,274

[22] Filed: Jul. 30, 1992

[30] Foreign Application Priority Data

Aug. 7, 1991 [JP] Japan ..... 3-070524[U]

[51] Int. Cl.[5] ..... B22D 11/128

[52] U.S. Cl. ..... 164/448; 72/226; 164/442

[58] Field of Search ..... 164/448, 442; 72/225, 72/226

[56] References Cited

U.S. PATENT DOCUMENTS 4,106,551 8/1978 Inoue ..... 164/448
4,640,338 2/1987 Kumagai ..... 164/448

FOREIGN PATENT DOCUMENTS 57-199555 12/1982 Japan ..... 164/442
58-97474 6/1983 Japan ..... 164/442
59-50961 3/1984 Japan ..... 164/442
59-212156 12/1984 Japan ..... 164/442
61-60746 12/1986 Japan .
2-11963 4/1990 Japan .
2105229A 3/1983 United Kingdom ..... 164/442

*Primary Examiner*—J. Reed Batten, Jr.
*Attorney, Agent, or Firm*—Nikaido Marmelstein Murray & Oram

[57] ABSTRACT

In curved continuous casting facilities, a roller apron is fabricated with upper and lower web rolls supported by upper and lower movable frames respectively to support the upper and lower surfaces of a web portion of a beam blank, in which the upper web rolls also support the upper surface of a rectangular strand such as a bloom; rectangular-piece rolls supported by a fixed frame to support the lower surface of a rectangular casting strand; wherein the lower web rolls can be retracted when the rectangular strand such as the bloom is being cast, and the upper and lower web rolls support their corresponding surfaces of the web and concurrently the rectangular-strand rolls support both flange-end portions of the beam blank. Consequently, tension sides of the beam blank and the rectangular strand such as bloom are positively supported to prevent problems, such as bulging, which occur during casting.

1 Claim, 4 Drawing Sheets

ROLLER APRON FOR BEAM BLANK AND RECTANGULAR STRAND IN CONTINUOUS CASTING FACILITIES

BACKGROUND OF THE INVENTION

1. Field of the Invention

The present invention relates to a roller apron which is compatible for casting both a beam-blank strand and a rectangular strand in a curved continuous casting facility.

2. Description of the Related Art

In curved continuous casting facilities of the conventional type compatible for casting both a beam blank strand (nearnet shape) and a rectangular strand, such as billet, bloom or slab, roller apron segments independently equipped with beam-blank rolls and rectangular-strand rolls are prepared and these segments are exchanged with other segments depending on the casting mode for each occasion, i.e. the casting of the beam blank or casting of the rectangular strand. Therefore, a great amount of time and the labor has been required for the operation of the above change over.

Accordingly, to improve the above change-over operation, a curved continuous casting facility which is compatible for casting both the beam-blank strand and the rectangular strand has been proposed in roller apron segments having a fixed frame and a movable frame. On the above fixed frame, web rolls are provided to support the web part of the beam blank or the bottom side of the rectangular strand such as the bloom in the outer portion of the casting radius. On the other hand, the counterpart web rolls are provided on the above movable frame to support the opposite side of the web part of the beam blank or the inner portion of the casting radius of the rectangular strand (refer to the Japanese Utility Model Examined Publication No. 2-11963 and Japanese Patent Examined Publication No. 61-60746 for example).

However, in the above proposed curved continuous casting facilities, because the web rolls disposed in the outside portion of the casting radius are fixed, a curved casting pass line can be maintained with high accuracy. However, as the same web rolls are to be used to support both the web of the beam blank strand (a connecting portion of two parallel sides in the section of, for example, I-section members or H-section members, namely each flange portions and a portion so called web) and the upper and lower surfaces of the rectangular strand (hereinafter, these positions are defined when the bloom is placed horizontally), there is a problem when the beam blank strand having a narrower web width is being cast. Under this circumstance, the web rolls for the combined use axially protrude over the sectional width of the beam blank which result in said rolls engaging with the flange portions of the beam blank, hence, the web rolls cannot support the web. Consequently, there are shortcomings in that not only unsolidified parts tend to remain in the web portion, but also an important tension side in the outer portion of the casting radius cannot be supported positively, and eventually such a problem as bulging will occur.

The following is a detailed description of the aforementioned Japanese Patent Publication No. 61-60746, wherein drum-shape rolls for the combination use of web and bloom are used; however, there is a problem in that when the axial length of the larger diameter portion of the roll is greater than the width of the beam blank, it is difficult to support the web. This is especially true when casting a small beam blank wherein the same problem as described before will occur.

SUMMARY OF THE INVENTION

In view of the above described problems of the prior art, it is an object of the present invention to provide a roller apron having one group of rolls for supporting an inner portion of a casting radius and having another group of rolls for supporting an outer portion of the casting radius at a predetermined position, and being compatible for casting both a beam-blank strand and a rectangular strand in curved continuous casting facilities. The roller apron comprises first web rolls for supporting the inner portion of the casting radius of the rectangular and beam-blank strand, which also is movably supported orthogonally to a casting pass line; rectangular-strand rolls for supporting the outer portion of the casting radius, and being supported at a predetermined position; second web rolls for supporting the outer portion of the casting radius of the web of the beam-blank piece, being movably supported orthogonally to the casting pass line, wherein the rectangular-piece rolls and the second web rolls for supporting the outer portion of the casting radius are disposed alternately along the pass line of the casting pieces.

DESCRIPTION OF THE PREFERRED EMBODIMENTS

Figure 1:
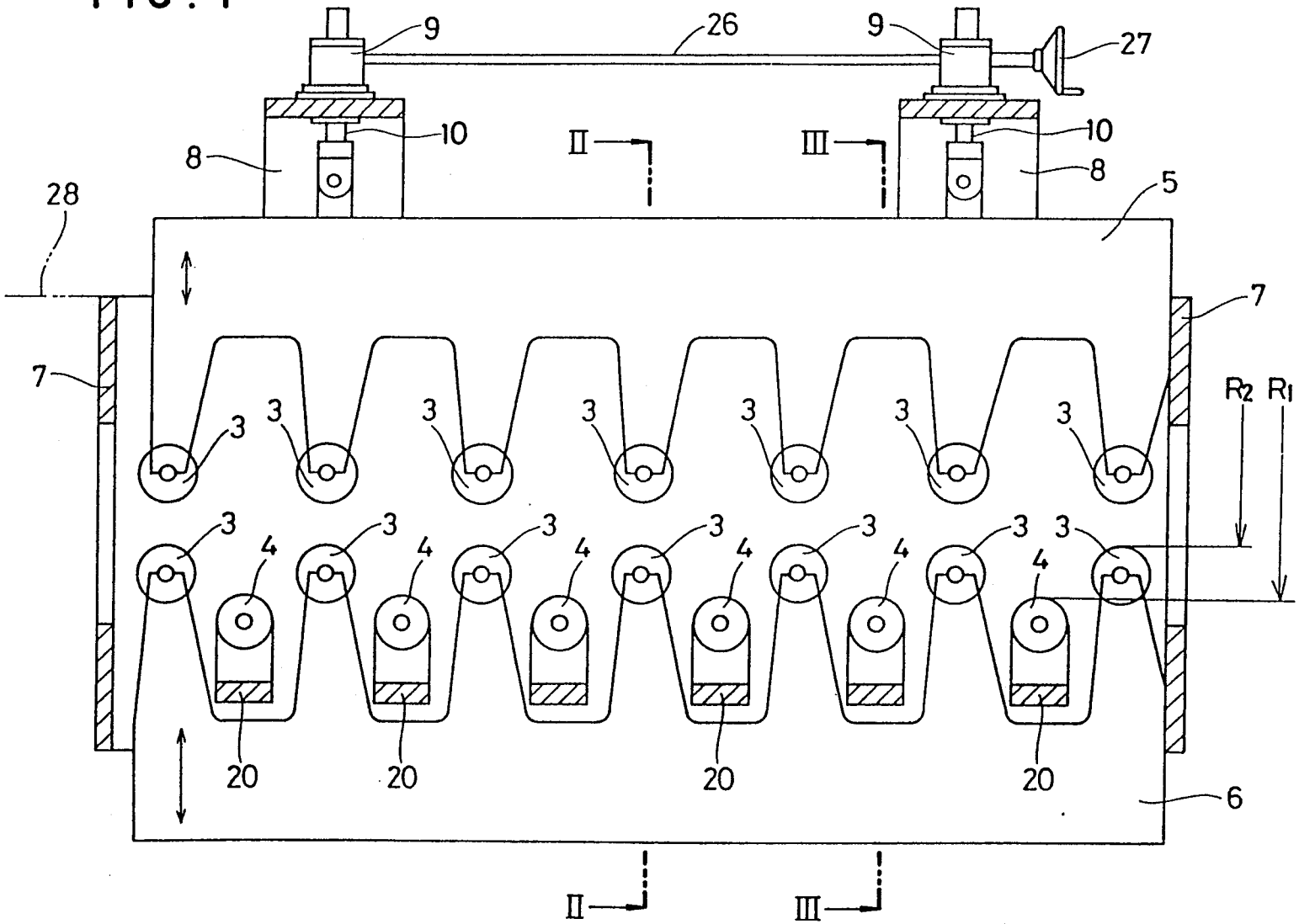
FIG. 1 is a schematic side view of an embodiment of the present invention.

A preferred embodiment is described to illustrate a roller apron of the present invention which is compatible for casting both a beam-blank strand and a rectangular strand such as bloom, billet, or slab in a curved continuous casting facility. Naturally, when changing over to a different type of strand in the apron, the casting mold and the top roller apron are to be changed in pairs due to their exclusive use for one type of strand; however, the embodiment of the present invention can be applied to the remainder parts of the roller apron, i.e. guide rolls or straightening rolls, except the top roller apron.

In the accompanying drawings, reference numeral 1 indicates the beam-blank strand and numeral 2 indicates the rectangular strand, then the top and bottom surfaces of a web 1*a* of the beam-blank strand 1 are supported by web rolls 3, 3. On the other hand, the top surface of the rectangular strand 2 is supported by upper web rolls 3, and its bottom surface is supported by rolls 4 for the rectangular strand. Albeit the diameters of the web roll 3 and the roll 4 for the rectangular strand are generally the same (10 cm), the axial length of the roll 4 for the rectangular strand is about 4 times longer than that of the web roll 3.

The upper web rolls 3 are rotatably supported by an upper movable frame 5 and the lower web rolls 3 are also rotatably supported by a lower movable frame 6. Then, the upper movable frame 5 is mounted through worm geared jacks 9 on a pair of gate-shape frames 8 perpendicularly mounted on a body frame 7 along a pass line. More particularly, the upper movable frame 5 is connected to rods 10 which extend from the worm geared jacks 9 mounted on the gate-shape frames 8 so as to move perpendicularly. Furthermore, as shown in FIG. 2, ribs 5*a* are mounted on both sides of the upper movable frame 5 and engaged with guide rails 8*a* to guide the up-and-down travel of the upper movable frame 5.

Figure 2:
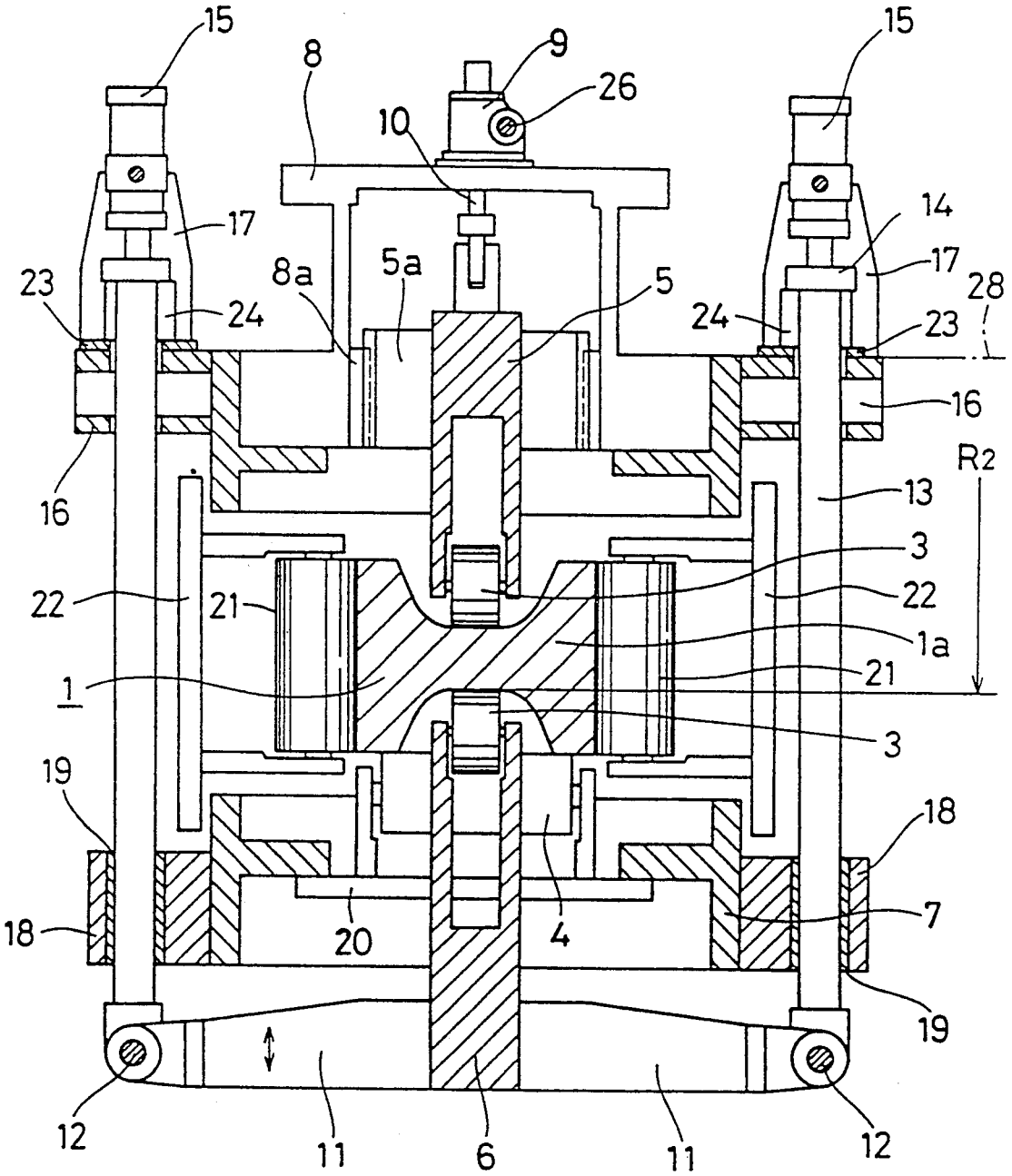
FIG. 2 is a sectional view generally taken along the line II—II of FIG. 1.

On the other hand, as shown in FIG. 2, elevation supporting rods 11, 11 are securely mounted on the lower movable frame 6 on both sides of which the rods 11, 11 extend in a generally horizontal direction. A pair of these elevation supporting rods 11 is provided along the pass line. Elevation shafts 13 are connected in a generally vertical direction to the outer ends of the elevation supporting rods 11 by means of pin connection 12, then, the elevation shafts 13 are connected to rods of hydraulic cylinders 15 through the flanges 14. The hydraulic cylinders 15 are swingably mounted on stands 17 which are perpendicularly mounted on brackets 16 attached to the body frame 7. Meanwhile, the elevation supporting shafts 13 pass through guiding members 19 which are provided in lower brackets 18 attached to the body frame 7 for guiding the up-and-down travel of the lower movable frame 6.

The rolls 4 for the rectangular strand are rotatably supported by the fixed frame 20 provided on the body frame 7. Then, the rolls 4 for the rectangular strand are provided in-between the lower web rolls 3 which are disposed along the pass line. Namely, the web rolls 3 and the rolls 4 for the rectangular strand are disposed alternately.

Both flange sides of the beam-blank strand 1 are supported by flange-side rolls 21, 21 in pairs. These paired flange-side rolls 21 facing with each other are rotatably supported by side frames 22 which are provided in the body frame 7. To facilitate an adjustment of the span of each paired flange-side rolls 21, the side frames 22 are so mounted on the body frame 7 as to be able to traverse horizontally.

Common sole plates 23 are placed on the body frame 7 and on the upper surfaces of upper brackets 16. On top of the sole plates 23, distance pieces 24 which are selectively exchangeable are slidably mounted. Each distance piece 24 is to be slid by a lever 25 attached to the stand 17 and also fitted into or out of an area between a flange 14 of the elevation shaft 13 and the sole plate 23.

In the attached drawings, reference numeral 26 indicates a rod connected to the worm shafts of the worm geared jacks 9, and reference numeral 27 indicates an operating handle to rotate the rod 26. Meanwhile, the upper surface of the body frame 7 is so structured as to conform with an outer wall 28 of a cooling chamber, which consequently works to prevent the hydraulic cylinders 15 or worm geared jacks 9 from being spattered with scales and cooling water.

Figure 3:
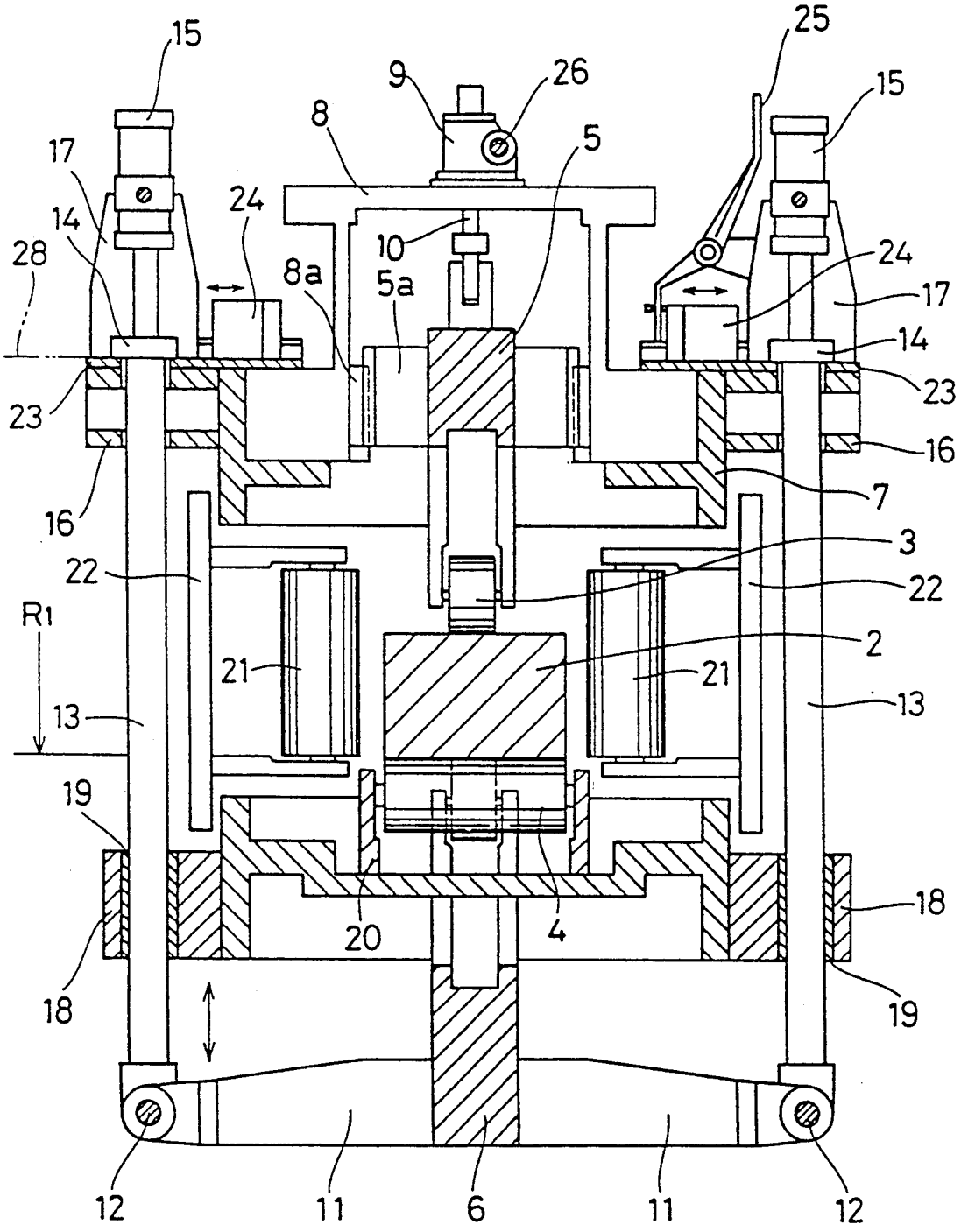
FIG. 3 is a sectional view generally taken along the line III—III of FIG. 1.
Figure 4:
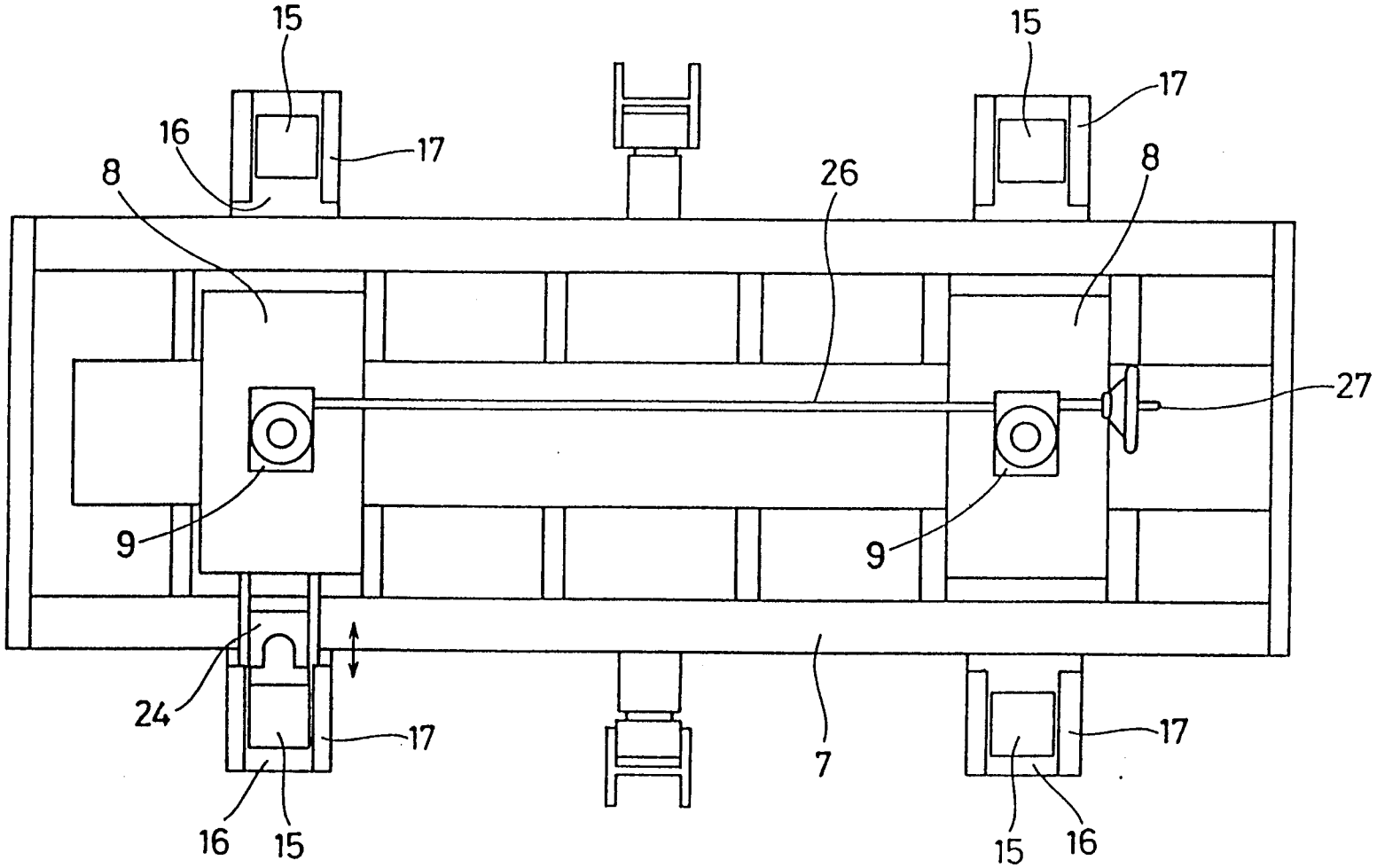
FIG. 4 is a plan view of FIG. 1.

An operation of the preferred embodiment of the present invention will now be described. To change over a casting mode from a beam-blank strand 1 as shown in FIG. 2 to a rectangular strand 2 as shown in FIG. 3, both the casting mold and the top roller apron should be replaced. In that situation, given that the width of the above mentioned rectangular strand 2 to be used is greater than the clearance between the flange-side rolls 21, 21 facing with each other, the rolls 21 should be moved backward, then each distance piece 24 should be slid by the lever 25 to be pulled out from an area between the flange 14 and the sole plate 23 mounted on the elevation shaft 13. Thereafter, when the four hydraulic cylinders are actuated to extend simultaneously, the pass line $R_1$ determined by an upper normal of rolls 4 for the rectangular strand via the following order: the elevation shafts 13, the elevation supporting rods 11, and the lower movable frame 6. Then, the height of the upper web rolls 3 should be adjusted in accordance with the thickness of the casting rectangular strand 2. Namely, the up-and-down movement of the rods 10 connected to the worm geared jacks 9 is done by means of the operating handle 27 which actuates the two worm geared jacks 9 through the rod 26. Consequently, the height adjustment of the upper web rolls 3 can be accomplished accurately because the upper movable frame 5 is descended or ascended by means of the guide rails 8*a* of the gate-shape frames 8 for guiding the upper movable frame 5. As a result, the rectangular strand 2 is supported by these rolls 4 for the rectangular strand and the upper web rolls 3. In this situation, the rolls 4 for the rectangular strand 2 are supported by the fixed frame 20, and the pass line $R_1$ of the rectangular strand 2 maintains the accuracy of the initial adjustment; therefore, an important tension side of the rectangular strand 2 can be accurately regulated, thus the quality of the rectangular strand 2 will not be impaired.

On the other hand, to change over a casting mode from a rectangular strand 2 as shown in FIG. 3 to a beam-blank strand 1 as shown in FIG. 2, both the casting mold and the top roller apron should be replaced and the horizontal clearance-adjustment of the flange-side rolls 21 should be done in the same manner as described above. Then, the four hydraulic cylinders 15 are retracted simultaneously to ascend the lower web rolls 3 via the following order: the elevation shafts 13, the elevation supporting rods 11, and the lower movable frame 6. Then, to enable the height adjustment of the upper web rolls 3, the distance pieces 24 of a pre-determined sizes, are to be fitted into the area between the flange 14 of the elevation shaft 13 and the sole plate 23. Thus an important tension side of each bottom end of the both flanges of the beam-blank strand 1 is securely supported by the rolls 4 for the rectangular strand at a predetermined position, and the lower web rolls 3 which support an important tension side of the beam-blank strand 1 are regulated in the height by the height of each distance piece; consequently, an accurate pass line $R_2$ of the beam blank can be obtained.

According to the present invention, the rectangular-strand rolls which support the outer portion of a casting radius of the rectangular strand are supported at a predetermined position; therefore, when the casting mode changes from the beam blank to the rectangular strand or vice versa, the strict pass line of the curved continuous casting facility can be accurately maintained. Furthermore, the web rolls can positively support the web of the beam-blank strand of any size, which will prevent the beam-blank strand from having problems, such as a bulging. In addition, the web rolls will not become an obstruction during the casting of the rectangular strand. Accordingly, a roller apron for both a beam-blank strand and a rectangular strand having high reliability and extreme versatility can be obtained. Furthermore, because the web rolls and the rectangular-piece rolls are alternately disposed in an outer portion of a casting radius, an elevating device of the web rolls can be simplified. In addition, in an inner portion of a casting radius, only the web rolls support both the rectangular strand and the beam-blank strand; therefore, the total device can be simplified, and the investment costs for the apron will be inexpensive.

What is claimed is:

1. A roller apron having one group of rolls for supporting an inner portion of a casting radius and having another group of rolls for supporting an outer portion of said casting radius at a predetermined position, and also being compatible for casting both a beam-blank strand and a rectangular strand in curved continuous casting facilities, said roller apron comprising:

first web rolls for supporting said inner portion of said casting radius of said rectangular strand and said beam-blank strand, and said first web rolls being movably supported orthogonally to a casting pass line;

rectangular-strand rolls for supporting said outer portion of said casting radius, and being supported at said predetermined position; and second web rolls for supporting said outer portion of said casting radius of a web of said beam-blank strand, being movably supported orthogonally to said casting pass line;

wherein said rectangular-strand rolls and said second web rolls for supporting said outer portion of said casting radius are disposed alternately along said pass line of said strand.

* * * * *